US005495139A

United States Patent [19]

Kamohara et al.

[11] Patent Number: 5,495,139

[45] Date of Patent: Feb. 27, 1996

[54] COLOR CATHODE RAY TUBE APPARATUS

[75] Inventors: Eiji Kamohara; Jiro Shimokobe, both of Fukaya, Japan

[73] Assignee: Kabushiki Kaisha Toshiba, Kawasaki, Japan

[21] Appl. No.: 83,693

[22] Filed: Jun. 30, 1993

[30] Foreign Application Priority Data

Jun. 30, 1992 [JP] Japan ..... 4-172715

[51] Int. Cl.[6] ..... H01J 29/50

[52] U.S. Cl. ..... 313/413; 313/433

[58] Field of Search ..... 313/412, 413, 313/414, 425, 426, 432, 439, 449, 433

[56] References Cited

U.S. PATENT DOCUMENTS

| | | | |
|---|---|---|---|
| 4,468,587 | 8/1984 | Sluyterman | 313/413 |
| 5,113,112 | 5/1992 | Shimoma et al. | 313/413 |
| 5,202,604 | 4/1993 | Kweon | 313/412 |
| 5,281,892 | 1/1994 | Kweon | 313/414 |

FOREIGN PATENT DOCUMENTS

| | | | |
|---|---|---|---|
| 57-6662 | 2/1982 | Japan | H01J 29/50 |

*Primary Examiner*—Edward L. Coles, Sr.
*Assistant Examiner*—Jerome Grant, II
*Attorney, Agent, or Firm*—Cushman Darby & Cushman

[57] ABSTRACT

In a color cathode ray tube apparatus wherein three in-line electron beams are deflected by horizontal and vertical deflection magnetic fields of a deflector. The three in-line electron beams are arranged along an axis that is inclined with respect to a horizontal axis perpendicular to the tube axis and are emitted from an electron beam producing unit. Of the three electron beams, the center beam is focused at a higher degree than the pair of side beams by an electric field lens forming unit. The pair of side beams are deflected by a deflecting unit in the direction of arrangement of the three electron beams away from the center beam and are made incident on a focusing magnetic field generating device constituting a common magnetic field focusing type electron lens for focusing and converging the three electron beams. Then, the three electron beams are directed to a phosphor screen. Accordingly, the electron beams are desirably focused and converged on the phosphor screen with a small beam spot size.

8 Claims, 5 Drawing Sheets

Sg3 > Sg4

COLOR CATHODE RAY TUBE APPARATUS

BACKGROUND OF THE INVENTION

1. Field of the Invention

The present invention relates generally to a color cathode ray tube apparatus, and more particularly to a color cathode ray tube apparatus wherein three in-line electron beams consisting of a center beam and a pair of side beams, which all travel in the same plane, are focused by a common magnetic field focusing type electron lens employed commonly for the three electron beams.

2. Description of the Related Art

There is a demand for a color cathode ray tube (CRT) apparatus capable of displaying a clear image with a higher resolution. In order to achieve such a CRT apparatus, it is necessary to reduce the beam spot diameter on a phosphor screen of an electron beam emitted from an electron gun assembly.

In order to meet the demand, Published Examined Japanese Patent Application (PEJPA) No. 57-6662 proposes a color CRT apparatus wherein two side cathode in a group of three cathodes are inclined with respect to the tube axis so as to make three in-line electron beams intersect in a magnetic field focusing type electron lens and to equalize the intensity of the magnetic field focusing type electron lens acting on the electron beams, and the occurrence of astigmatism or coma-aberration in the pair of side beams is prevented, whereby the three electron beams are focused in an equal focused state.

In the apparatus having the above structure, the pair of side beams are made to intersect in the lens and then travel in a direction away from the center beam. The side beams are intensely deflected towards the center beam by an electrostatic deflecting plate, and the three electron beams are converged at one point on a center region of the screen. Although the axis of arrangement of the three electron beams is rotated about the tube axis, such a rotation is corrected by arranging the three cathodes with an inclination to the horizontal axis of the deflected magnetic field (the horizontal axis perpendicular to the tube axis). Thereby, a convergence error of the three electron beams is prevented.

However, in the apparatus of the above structure, the two side cathodes of the three cathodes must be arranged at a precise inclination with respect to the center cathode. It is difficult to assemble the electron gun assembly with high precision. In addition, after the three electron beams have passed through the common magnetic field focusing type electron lens, the pair of side beams which travel away from the center beam are intensely deflected towards the center beam by the electrostatic deflecting plate. Thus, a deflection aberration given to the three electron beams is high, and the three electron beams cannot be converged on the phosphor screen in the same focused state. Therefore, practically required image quality cannot be obtained.

As has been described above, if the magnetic field focusing type electron lens is used, the three electron beams cannot be converged at one point on the phosphor screen and the image plane is rotated with respect to the object point. Accordingly, if the horizontal in-line three electron beams are focused by the magnetic field focusing type electron lens, a considerable convergence error occurs at the peripheral region on the screen. This convergence error cannot be completely corrected even if the distributions of horizontal and vertical deflection magnetic fields of the deflector are adjusted.

Furthermore, in the conventional apparatus, the deflection aberration is large, and the three electron beams cannot be converged on the phosphor screen in the same focused state.

SUMMARY OF THE INVENTION

The object of the present invention is to provide a color cathode ray tube apparatus wherein even if a common magnetic field focusing type electron lens is used, three in-line electron beams can be desirably focused on a phosphor screen and also desirably converged on the entire screen.

According to the invention, there is provided a color cathode ray tube apparatus wherein three in-line electron beams consisting of a center beam and a pair of side beams are deflected by horizontal and vertical deflection magnetic fields produced by a deflector. The color cathode ray tube apparatus comprises an electron beam producing unit for producing the three in-line electron beams having the axis of arrangement inclined with respect to a horizontal axis perpendicular to the tube axis, an electric field lens forming unit for focusing the center beam at a higher degree than the pair of side beams, a deflecting unit for deflecting the pair of side beams in the direction of arrangement of the three electron beams away from the center beam, and a focusing magnetic field generating device constituting a common magnetic field focusing type electron lens which is common to the three electron beams and focuses and converges the three electron beams.

If the common magnetic field focusing type electron lens for focusing and converging the three in-line electron beams is constituted by the focusing magnetic field generating device, the aperture of the electron lens can be made greater than the outside diameter of the neck. In addition, the spherical aberration can be decreased, and the beam spot size on the phosphor screen can be reduced.

If the axis of arrangement of the three in-line electron beams produced by the electron beam producing unit is inclined with respect to the horizontal axis, the rotation of the axis of arrangement of the three electron beams, which is due to the image-plane rotating action of the magnetic field focusing type electron lens common to the three electron beams, can be corrected, and the axis of arrangement of the three electron beams can be made to coincide with the horizontal axis. Thereby, a convergence error of the three electron beams at the peripheral portions of the screen can be corrected.

If the deflecting unit is provided for deflecting the pair of side beams in the direction of arrangement of the three electron beams away from the center beam, it becomes possible to correct a convergence error of the three electron beams at the center portion of the screen, which error is caused by the over-convergence state of the pair of side beams when the three electron beams are focused by the common electric field focusing type electron lens.

Therefore, with the above structure, the beam spot size on the phosphor screen can be reduced, and the three in-line electron beams can be desirably converged on the entire screen.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A color cathode ray tube (CRT) apparatus according to an embodiment of the present invention will now be described with reference to the accompanying drawings.

Figure 1:
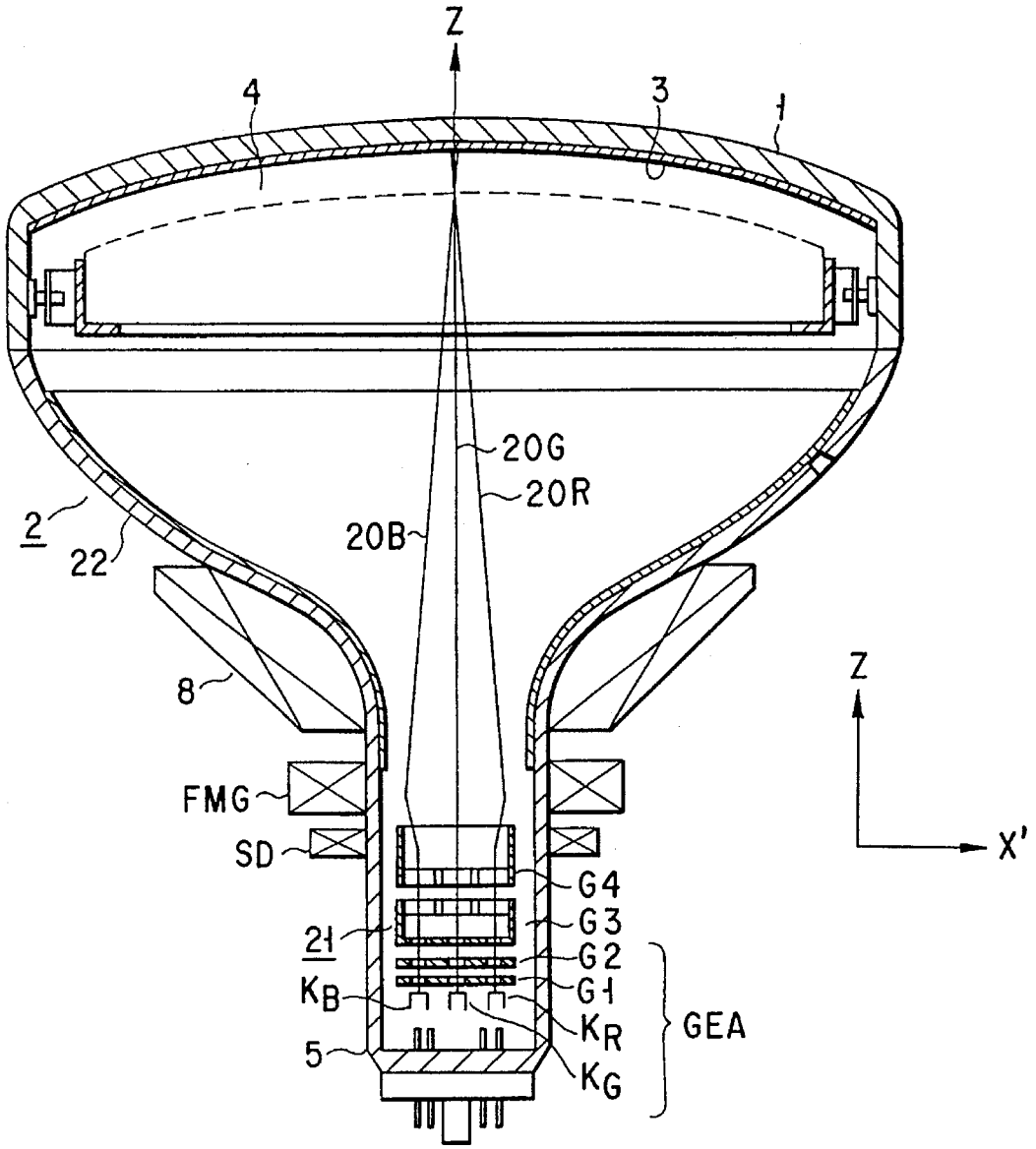
FIG. 1 is a cross-sectional view showing the structure of a color CRT apparatus according to an embodiment of the present invention.
Figure 2:
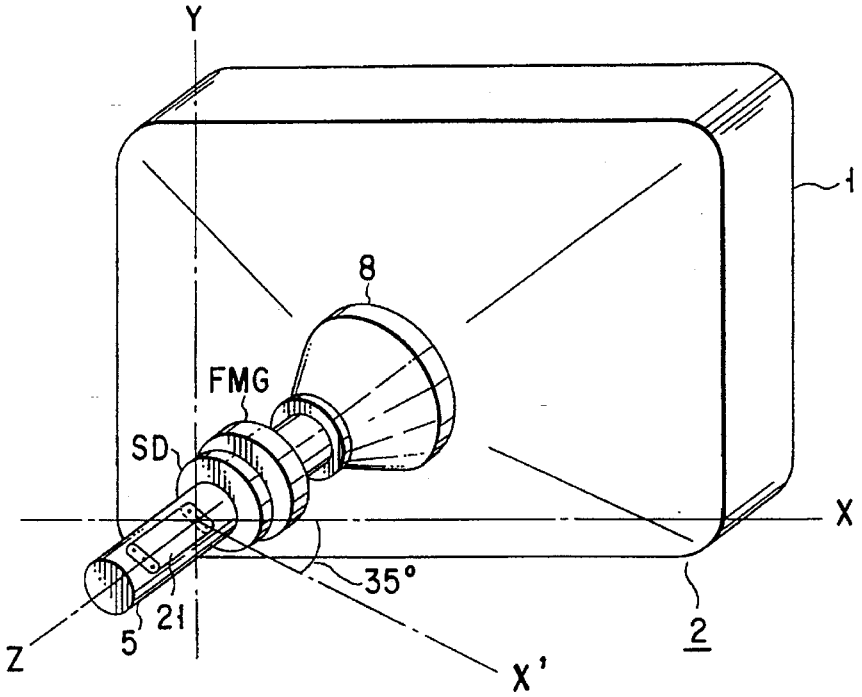
FIG. 2 is a perspective view showing the rear side of the color CRT apparatus shown in FIG. 1.

FIGS. 1 and 2 show a color CRT apparatus according to an embodiment of the invention. In FIGS. 1 and 2, the CRT apparatus has an envelope comprising a substantially rectangular panel 1 and a funnel 2 coupled integrally to the panel 1. A phosphor screen 3 comprising stripe-shaped three-color phosphor layers for emitting blue, green and red light is formed on the inner surface of the panel 1. A shadow mask 4 having a number of electron beam passage holes is mounted on the inside of the phosphor screen 3 so as to face the screen 3. An electron gun assembly 21 for emitting in-line three electron beams 20B, 20G and 20R is situated within a neck 5 of the funnel 2. The beam 20G is a center beam, and the beams 20B and 20R are side beams. These beams travel in the same plane. On the outside of the neck 5 of funnel 2, there are provided a focusing magnetic field generator FMG for generating a magnetic field for focusing the electron beams and a side-beam deflector SD for deflecting the side beams. In addition, on the outside of a boundary portion between a large-diameter portion of the funnel 2 and the neck 5, there is provided a deflector 8 for generating a pincushion type horizontal deflection magnetic field for horizontally deflecting the three electron beams 20B, 20G and 20R and for generating a barrel-type vertical deflection magnetic field for vertically deflecting the three beams 20B, 20G and 20R.

The electron gun assembly 21 comprises three in-line cathodes KB, KG and KR, inclined by about 35° with respect to a horizontal axis (X-axis) as shown in FIG. 2, three heaters (not shown) for heating the cathodes KB, KG and KR individually, and first to fourth grids G1 to G4 arranged successively from the cathode side towards the phosphor screen.

Figure 3:
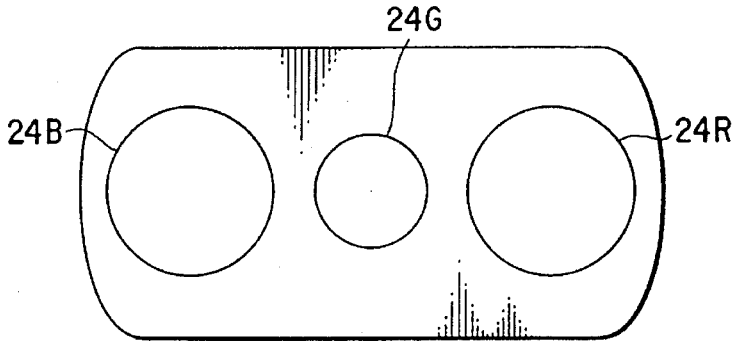
FIG. 3 is a plan view showing the shapes of electron beam passage holes formed in a part of a third grid, which faces a fourth grid, and in a part of the fourth grid, which faces the third grid, of an electron gun assembly in the color CRT apparatus shown in FIG. 1.
Figure 4:
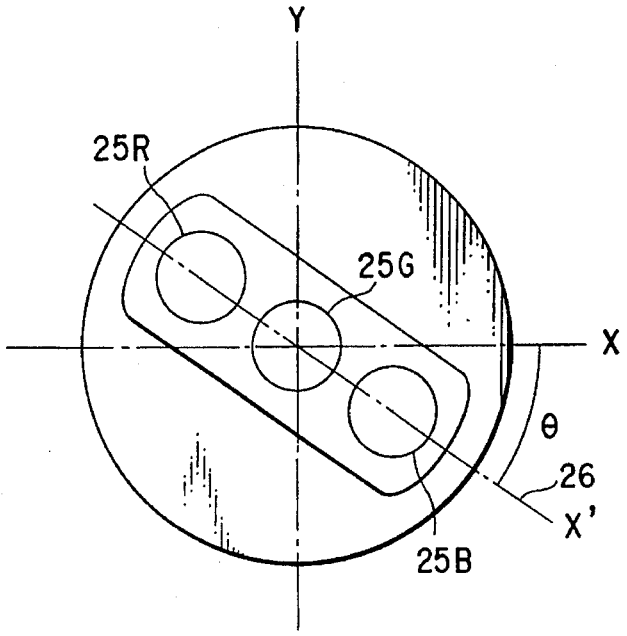
FIG. 4 is a plan view showing the inclination of the axis of arrangement of the electron beam passage holes of the first to fourth grids of the electron gun assembly of the color CRT apparatus of FIG. 1.

The first grid G1 and second grid G2 are formed of integral plate electrodes, respectively. These electrodes have three electron beam passage in-line holes which face the three cathodes KB, KG and KR and have the same relatively small size. The third grid G3 is formed of an integral cylindrical electrode, and the fourth grid G4 is formed of an integral cup-shaped electrode. That part of the third grid G3, which faces the second grid G2, is provided with three electron beam passage holes having the same size. The size of each beam passage hole of the third grid G3 is slightly greater than that of each beam passage hole formed in the first grid G1 and second grid G2. The beam passage holes of the third grid G3 are arranged in an in-line fashion coaxially with the three electron beam passage holes of the second grid G2. That part of the third grid G3, which faces the fourth grid G4, and that part of the fourth grid G4, which faces the third grid G3, are respectively provided with three larger electron beam passage holes which are arranged in an in-line fashion coaxially with the electron beam passage holes formed in that part of the third grid G3 which faces the second grid G2. As is shown in FIG. 3, the three electron beam passage holes formed in that part of the third grid G3 facing the fourth grid G4 as well as that part of the fourth grid G4 facing the third grid G3 are formed such that a center beam passage hole 24G is smaller than each of a pair of side-beam passage holes 24B and 24R and is greater than each of the electron beam passage holes formed in that part of the third grid G3 which faces the second grid G2. In addition, as shown in FIG. 4, an arrangement axis of 26 of the in-line electron beam passage holes (denoted by 25B, 25G and 25R in FIG. 4) formed in the three cathodes KB, KG and KR and first to fourth grids G1 to G4 is inclined by 35° with respect to a horizontal axis which is perpendicular to the axis of the CRT apparatus (i.e. the tube axis).

Figure 6A:
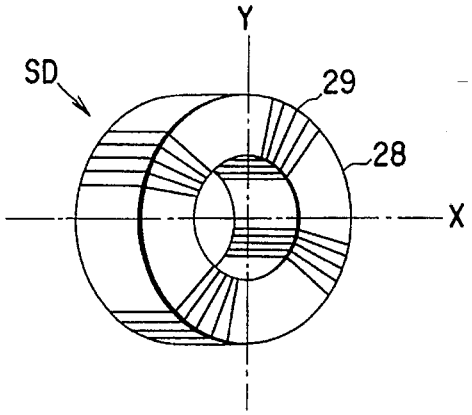
FIG. 6A is a perspective view showing the structure of a side beam deflector of the color CRT apparatus of FIG. 1.
Figure 6B:
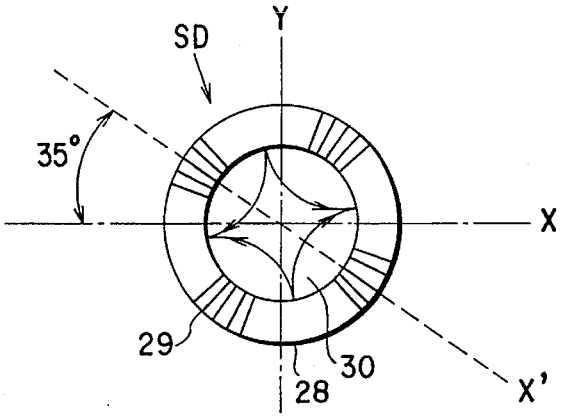
FIG. 6B is a plan view showing a magnetic field generated by the side beam deflector of the color CRT apparatus of FIG. 1.

The side-beam deflector SD is constructed such that a coil 29 is wound around an annular core 28 so as to generate a four-pole magnetic field, as shown in FIGS. 6A and 6B. The side-beam deflector SD is situated outside the neck 5 in a position corresponding to the fourth grid G4 of the electron gun assembly 21.

The focusing magnetic field generator FMG is formed of an annular permanent magnet or an electromagnetic coil for generating a magnetic field in the tube-axis (Z-axis) direction in a region where the three electron beams 20B, 20G and 20R travel. The field generator FMG is situated on the outside of the neck 5 on that side of the side-beam deflector SD which closer to the screen. The field generator FMG generates a magnetic field in the tube-axis direction near the fourth grid G4 and constitutes a common magnetic field focusing type electron lens for the three electron beams 20B, 20G and 20R.

According to the color CRT apparatus having the above structure, the following advantages can be obtained in connection with the focusing and convergence of the three electron beams 20B, 20G and 20R.

Figure 5:
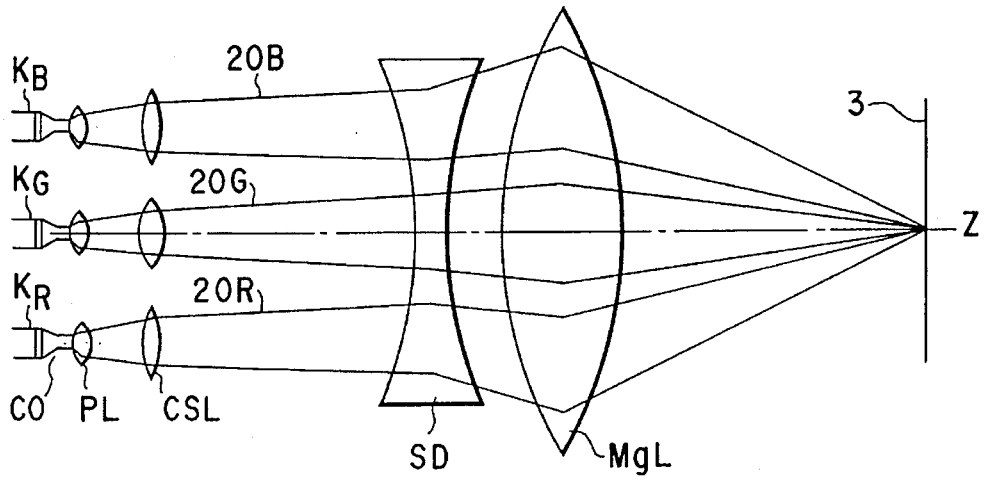
FIG. 5 is an optical model diagram for explaining the focusing of electron beams in the color CRT apparatus of FIG. 1.

Referring to FIG. 1, regarding the focusing of three electron beams 20B, 20G and 20R, the three cathodes KB, KG and KR and first and second grids G1 and G2 of the electron gun assembly 21 control the emission of the electron beams 20B, 20G and 20R from the cathodes KB, KG and KR. These elements constitute an electron beam forming unit GEA for accelerating the emitted electron beams 20B, 20G and 20R. As is shown in FIG. 5, the electron beams 20B, 20G and 20R emitted from the electron beam forming unit GEA with crossovers CO are slightly focused by pre-focusing lenses PL constituted by the second and third grids.

The electron beams slightly focused by the pre-focusing lenses PL are also slightly focused by center/side focus adjusting lenses CSL (electron lens forming unit) constituted by the third and fourth grids. In the center/side focus adjusting lenses CSL, the electron beam passage holes are formed in that part of the third grid G3 facing the fourth grid G4 and in that part of the fourth grid G4 facing the third grid G3, such that the center beam passage hole 24G is smaller than each of the side-beam passage holes 24B and 24R, as shown in FIG. 3. Thus, as shown in FIG. 5, a higher-intensity electron lens is formed for the center beam 20G than for the side beams 20B and 20R. As a result, in the center/side focus adjusting lenses CSL, the center beam 20G is more focused than the side beams 20B and 20R.

Of the three electron beams 20B, 20G and 20R focused by the center/side focus adjusting lenses CSL, only the pair of side beams 20B and 20R are deflected in a direction away from the center beam 20G by the four-pole magnetic field formed by the side beam deflector SD situated outside the neck 5. The resultant beams are made incident on a common magnetic field focusing type electron lens MgL constituted by the focusing magnetic field generator FMG situated outside the neck 5. The electron beams 20B, 20G and 20R are focused on the phosphor screen 3 by the electron lens MgL constituted by the field generator FMG. In this case, the center beam 20G passes through a center portion of the lens MgL, and the side beams 20B and 20R pass through peripheral portions of the lens MgL. Thus, the side beams 20B and 20R are more focused than the center beam 20G (according to general characteristics of an electron lens, a focusing function is stronger in a peripheral portion than in a center portion). As a result, a difference in focusing degree between the side beams 20B and 20R and the center beam 20G which has already been more focused than the side beams 20B and 20R by the center/side focus adjusting lens CSL is corrected, and the center beam 20G and side beams 20B and 20R are optimally focused on the phosphor screen 3.

Specifically, in the common magnetic field focusing type electron lens MgL constituted by the focusing magnetic field generator, the side beams 20B and 20R are more influenced by the focusing function than the center beam 20G. Thus, in the case where the center/side focus adjusting lens CSL is not provided, if the center beam is optimally focused on the phosphor screen, the side beams are over-focused. However, if the center/side focusing adjusting lens CSL is provided and the center beam 20G is focused independently from the electron lens MgL, the difference in focusing degree between the center beam 20G and side beams 20B and 20R due to the electron lens MgL is corrected and the three electron beams 20B, 20G and 20R can optimally be focused on the phosphor screen 3.

The side beams are influenced by the focusing function in the peripheral portion of the common magnetic field focusing type electron lens MgL. Thus, there is a possibility that a so-called "coma-aberration" occurs in which outside electron beams are more focused than inside electron beams. In this embodiment, however, the side beam deflector SD is situated on the cathode side of the electron lens MgL, and the four-pole magnetic field common to the three electron beams is generated. By the four-pole magnetic field, the outside portions of the side beams 20B and 20R are more deflected away from the center beam 20G than the inside portions thereof. Accordingly, the coma-aberration of the electron lens MgL is corrected and the side beams are desirably focused.

The common magnetic field focusing type electron lens MgL constituted by the focusing magnetic field generator FMG is not restricted by geometric factors due to the diameter of the neck, unlike a regular electrostatic type electron gun assembly, and the aperture of the electron lens MgL can be increased as desired. Thus, the spherical aberration can be decreased. Thereby, the beam spot on the phosphor screen 3 can be decreased, and the resolution can be enhanced.

As regards the convergence of the three electron beams 20B, 20G and 20R, in the color CRT apparatus having the above structure, the three electron beam passage holes of each of the first to fourth grids G1 to G4 are formed coaxially with the three in-line cathodes KB, KG and KR. Thus, the electron beams 20B, 20G and 20R travel from the cathodes KB, KG and KR in parallel, and the orbits of the side beams 20B and 20R are deflected away from the center beam 20G by the four-pole magnetic field generated by the side beam deflector SD. Thereby, the side beams 20B and 20R are made incident on the electron lens MgL, while diverging with respect to the tube axis. The side beams 20B and 20R are deflected towards the center beam 20G by the electron lens MgL and converged correctly on the phosphor screen 3.

If the three electron beams are made incident in parallel on the common magnetic field focusing type electron lens MgL, the force acting on the side beams 20B and 20R is too great to converge the three electron beams 20B, 20G and 20R on the phosphor screen 3, and over-convergence occurs. In this embodiment, however, the side beam deflector SD is situated on the cathode side of the focusing magnetic field generator FMG and the four-pole magnetic field is generated in the direction as shown in FIG. 6B to deflect the orbits of the side beams 20B and 20R away from the center beam 20G. Thus, the over-convergence of the beams 20B, 20G and 20R due to the electron lens MgL is corrected and these beams are correctly converged on the phosphor screen 3.

As regards the rotation of image due to the common magnetic field focusing type electron lens MgL constituted by the focusing magnetic field generator FMG, if the three in-line electron beams are horizontally focused by a common magnetic field focusing type electron lens, as in the regular electron gun assembly, the axis of arrangement of the three beams is inclined with respect to the horizontal axis (X-axis) by the image-rotating function of the electron lens when the three beams are emitted. If the rotated three electron beams are deflected by the pincushion-type horizontal deflection magnetic field and barrel-type vertical deflection magnetic field generated by the deflector, a convergence error of the three electron beams occurs in the peripheral portion on the screen and color dislocation occurs. In addition, the convergence error cannot be corrected even if the distributions of the horizontal deflection magnetic field and vertical deflection magnetic field are varied.

However, as shown in FIG. 4, the three cathodes KB, KG and KR and the axis of arrangement of the three in-line electron beam passage holes in each of the first to fourth grids G1 to G4 arranged successively on these cathodes are inclined by θ with respect to the horizontal axis in a direction opposite to the direction of the image rotation. In this case, the three electron beams 20B, 20G and 20R enter the common magnetic field focusing type electron lens MgL with an inclination θ with respect to the horizontal axis. When the three beams emanate from the electron lens MgL, the axis of arrangement of the beams coincides with the horizontal axis. As a result, the convergence error of the three electron beams 20B, 20G and 20R due to the image rotation can be corrected, and the color dislocation can be prevented.

It was found by the experiments conducted by the inventors that the inclination θ of the axis of arrangement of the three electron beams 20B, 20G and 20R can be set at about 35° before the beams are made incident on the electron lens MgL, in the case where the side beam deflector SD is situated on the cathode side of the electron lens MgL. The angle θ, however, varies slightly depending on the size of the focusing magnetic field generator FMG, the distance between the side beam 20B, 20R and the center beam 20G, and therefore it should be in the range of 20° to 50°.

Figure 7:
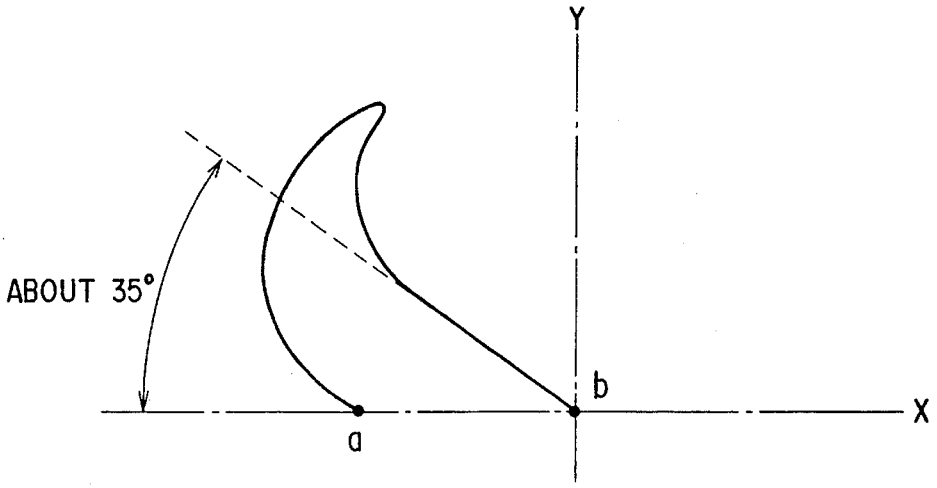
FIG. 7 shows a calculation result of an electron beam orbit of the color CRT apparatus of FIG. 1.

The inclination angle of the axis of arrangement of the three electron beams 20B, 20G and 20R before they are incident on the electron lens MgL will now be explained on the basis of the calculation results of electron beam orbits obtained by the inventors. FIG. 7 illustrates the calculation results of the electron beam orbit in the case where a single electron beam is made incident on a peripheral portion of the common magnetic field focusing type electron lens while the single beam is diverged from one point on the horizontal axis in the horizontal direction with respect to the tube axis. In FIG. 7, the electron beam orbit is observed in the direction of the tube axis (Z-axis). Point a indicates a start point, and b indicates a point on the screen at which the beam arrives. As can be seen from the calculation results, when the electron beam is made incident on the lens while it is diverged, the electron beam travels such that it is rotated by the common magnetic field focusing type electron lens with respect to the tube axis. Convergence is attained on the screen when the axis of arrangement is rotated by the inclination angle of about 35° as shown in FIG. 7.

As is clear from the calculation result of the electron beam orbit, it was found that the inclination θ of the axis of arrangement of the three electron beams 20B, 20G and 20R can suitably be set at about 35° before the beams are made incident on the electron lens MgL, in the case where the side beam deflector SD is situated on the cathode side of the electron lens MgL. This fact was confirmed by computer simulation.

In brief, the common magnetic field focusing type electron lens MgL is constituted by the focusing magnetic field generator FMG for the three in-line electron beams 20B, 20G and 20R. The center/side focusing adjustment lens CSL is provided to focus the center beam 20G more intensely than the side beams 20B and 20R. The side beam deflector SD is provided on the cathode side of the common magnetic field focusing type electron lens in order to deflect the side beams 20B and 20R away from the center beam 20G. The direction of arrangement of the three cathodes KB, KG and KR and the direction of arrangement of the electron beam passage holes of each of the grids G1 to G4, through which the three electron beams travel, is inclined by 20° to 50° with respect to the horizontal axis before the three beams are made incident on the common magnetic field focusing type electron lens MgL. Thereby, the problems of focusing, convergence and image rotation of the three in-line electron beams 20B, 20G and 20R due to the electron lens MgL are optimally solved, and the beam spot on the phosphor screen 3 is decreased. Accordingly, there can be obtained the color CRT apparatus wherein the resolution is enhanced and the three electron beams 20B, 20G and 20R are optimally converged on the entire screen.

In the above embodiment, the side beam deflector SD for deflecting the side beams away from the center beam is provided with the coil for generating the four-pole magnetic field. However, electrodes for generating a four-pole electric field may be provided within the neck.

For example, an electrostatic deflection plate may be used to individually deflect the side beams from the center beam. In this case, the coma-aberration may be corrected at areas other than the common magnetic field focusing type electron lens.

The side beam deflector SD may not be used as means for deflecting the side beams away from the center beam. Instead, in the electron gun assembly, the axes of the guns of both side beams may be inclined in advance in such a direction as to deflect the side beams away from the center beam.

Figure 8:
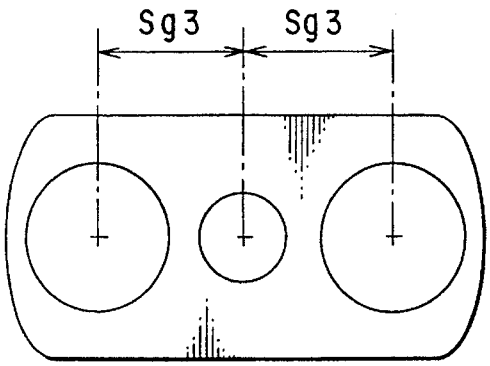
FIGS. 8 and 9 are plan views showing the shapes of electron beam passage holes of third and fourth grids of an electron gun assembly built in a color CRT apparatus according to another embodiment of the invention.
Figure 9:
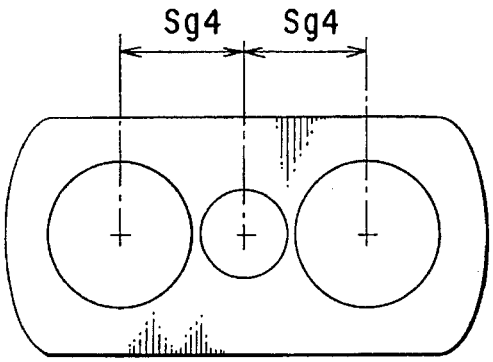
Figure 10:
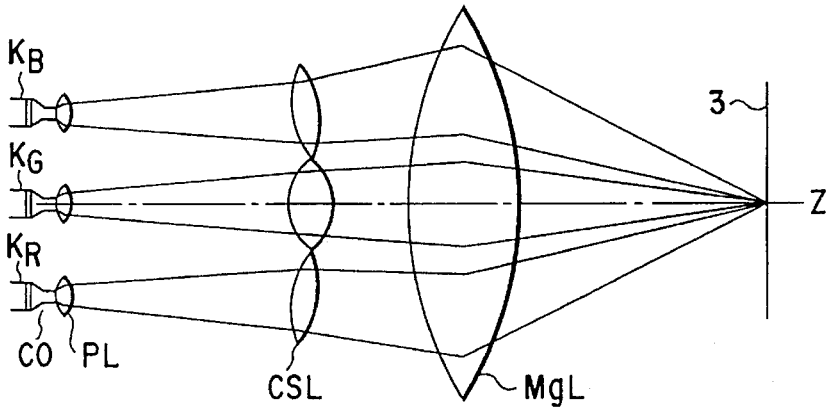
FIG. 10 is an optical model diagram for explaining the focusing of electron beams of the color CRT apparatus in which the electron gun assembly having the grids shown in FIGS. 8 and 9.

Furthermore, the side beam deflector and the electric field lens forming unit may be constructed by the same apparatus. Specifically, the side beam deflector SD serving as the magnetic field generator as shown in FIG. 6 and the third and fourth grids G3 and G4 as shown in FIG. 3 may be replaced by third and fourth grids G3 and G4 having structures as shown in FIGS. 8 10 and 9. As is clear, the color cathode ray tube apparatus comprising the third and fourth grids G3 and G4 as shown in FIGS. 8 and 9 has the structure obtained by removing the side beam deflector SD from the color cathode ray tube apparatus shown in FIG. 1.

As regards the third grid G3 and fourth grid G4 shown in FIGS. 8 and 9, the center beam passage hole is smaller than each of the side beam passage holes. An interval Sg3 between the center beam passage hole and each side beam passage hole of the third grid G3 is greater than an interval Sg4 between the center beam passage hole and each side beam passage hole of the fourth grid G4 (Sg3>Sg4). In other words, the center of the center beam passage hole of the third grid G3 coincides with the center of the center beam passage hole of the fourth grid G4, but the center of each side beam passage hole of the third grid G3 does not coincide with the center of each side beam passage hole of the fourth grid G4. The center of each side beam passage hole of the fourth grid G4 is deviated to the tube axis, as compared with the center of each side beam passage hole of the third grid G3.

In the above structure, a higher potential is applied to the fourth grid G4 than to the third grid G3, and the electron lens is formed between the third grid G3 and the fourth grid G4. The optical system including the electron lens CSL may be illustrated by an optical model as shown in FIG. 10. As is shown in FIG. 10, the electron lenses CSL have a higher focusing force for the center beam than for the side beams, and the lenses CSL deflect the side beams outwardly with respect to the tube axis. Accordingly, the side beams are less focused by the electron lenses CSL than the center beam, and the side beams are deflected outwards and made incident on the peripheral portions of the common magnetic field focusing type electron lens MgL. As a result, like the lens system shown in FIG. 5, the three electron beams can surely be focused and converged on the screen.

According to the present invention, the spherical aberration can be decreased and the beam spot size on the screen can be reduced. In addition, the beams can desirably be focused. It is also possible to correct a convergence error of the three electron beams on the center area of the screen due to over-convergence of the pair of side beams, when the three electron beams are focused by the common magnetic field focusing type electron lens. Furthermore, the rotation of the axis of arrangement of the three electron beams due to the image-plane rotating action of the common magnetic field focusing type electron lens is corrected, so that the axis of arrangement of the three electron beams at the peripheral portions of the screen can be made to agree with the horizontal axis. Thereby, the convergence error of the three electron beams at the peripheral portions of the screen can be corrected.

According to the above structure, there can be obtained a color CRT apparatus wherein the beam spot on the phosphor screen is small and the beams can desirably be focused, and the three in-line electron beams can desirably be converged on the entire screen.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus having a tube axis and a horizontal axis perpendicular to the tube axis, comprising:

an electron beam producing unit for producing three in-line electron beams including a center beam and a pair of side beams, said three in-line electron beams being arranged on a first axis that is inclined with respect to said horizontal axis;

electron lens forming means for focusing said center beam at a higher degree than said pair of side beams and for deflecting said pair of side beams outwardly with respect to said tube axis;

focusing magnetic field generating means defining a magnetic field focusing type electron lens which is common to said three in-line electron beams and generates a focusing/converging magnetic field to focus and converge said three in-line electron beams; and deflecting means for generating a horizontal deflection magnetic field for deflecting said three in-line electron beams horizontally and for generating a vertical deflection magnetic field for deflecting said three in-line electron beams vertically.

2. The apparatus according to claim 1, wherein said first axis is inclined at an angle in a range of 20° to 50° with respect to said horizontal axis.

3. The apparatus according to claim 1, wherein said electron beam producing means includes a pair of electrodes which form an electron lens and face each other, each of said pair of electrodes having beam passage holes defined therein for allowing passage of said center beam and said pair of side beams, the beam passage hole for allowing passage of the center beam being smaller than each of said beam passage holes for allowing passage of said side beams.

4. The apparatus according to claim 1, wherein said electron beam producing means includes a first electrode and a second electrode which face each other and form an electron lens, said first and second electrodes having beam passage holes defined therein for allowing passage of said center beam and said pair of side beams, said beam passage hole for allowing passage of said center beam being smaller than each of said beam passage holes for allowing passage of said side beams, a distance between said center beam and each of said side beams passing through said first electrode being greater than a distance between said center beam and each of said side beams passing through said second electrode, and wherein said electron beams passing through said first electrode enter said second electrode.

5. A color cathode ray tube apparatus having a tube axis and a horizontal axis perpendicular to the tube axis, comprising:

an electron beam producing unit for producing three in-line electron beams including a center beam and a pair of side beams, said three in-line electron beams being arranged on a first axis that is inclined with respect to said horizontal axis;

electric field forming means for focusing said center beam at a higher degree than said pair of side beams;

diverging magnetic field lens for deflecting said pair of side beams outwardly with respect to said center beam along said first axis;

focusing magnetic field generating means defining a magnetic field focusing type electron lens which is common to said three in-line electron beams for generating a focusing/converging magnetic field to focus and converge said three in-line electron beams; and deflecting means for generating a horizontal deflection magnetic field for deflecting said three in-line electron beams horizontally and a vertical deflection magnetic field for deflecting said three in-line electron beams vertically.

6. The apparatus according to claim 5, wherein said diverging magnetic field lens has four magnetic poles and a through hole defined therein for permitting said three in-line electron beams to pass therethrough.

7. The apparatus according to claim 5, wherein said first axis is inclined at an angle in a range of 20° to 50° with respect to said horizontal axis.

8. The apparatus according to claim 5, wherein said electron beam producing means includes a pair of electrodes which face each other and form an electron lens, each of said pair of electrodes having beam passage holes defined therein for allowing passage of said center beam and said pair of side beams, said beam passage hole for allowing passage of said center beam being smaller than each of said beam passage holes for allowing passage of said side beams.

* * * * *